US010578116B2

(12) United States Patent
Hayashi et al.

(10) Patent No.: US 10,578,116 B2
(45) Date of Patent: Mar. 3, 2020

(54) ROTATIONAL BODY AND METHOD FOR MANUFACTURING THE SAME

(71) Applicant: MITSUBISHI HEAVY INDUSTRIES, LTD., Tokyo (JP)

(72) Inventors: Noriyuki Hayashi, Tokyo (JP); Makoto Ozaki, Tokyo (JP); Nariaki Seike, Tokyo (JP); Hiroshi Kanki, Tokyo (JP); Hiroshi Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 464 days.

(21) Appl. No.: 15/032,726

(22) PCT Filed: Dec. 11, 2013

(86) PCT No.: PCT/JP2013/083206
§ 371 (c)(1),
(2) Date: Apr. 28, 2016

(87) PCT Pub. No.: WO2015/087414
PCT Pub. Date: Jun. 18, 2015

(65) Prior Publication Data

US 2016/0273545 A1 Sep. 22, 2016

(51) Int. Cl.
*F04D 29/26* (2006.01)
*F01D 5/02* (2006.01)
(Continued)

(52) U.S. Cl.
CPC ..... *F04D 29/266* (2013.01); *F01D 5/025* (2013.01); *F04D 29/053* (2013.01);
(Continued)

(58) Field of Classification Search
CPC ..... F01D 5/025; F04D 29/266
See application file for complete search history.

(56) References Cited

U.S. PATENT DOCUMENTS 4,769,996 A * 9/1988 Barbeau ..... F02C 7/22 60/745
4,941,760 A 7/1990 Suzuki et al.
(Continued)

FOREIGN PATENT DOCUMENTS

CN 2517874 Y 10/2002
CN 1555461 A 12/2004
(Continued)

OTHER PUBLICATIONS

Sato, JP 2005002849 A, Jan. 6, 2005, English Translation.*
(Continued)

*Primary Examiner* — Woody A Lee, Jr.
*Assistant Examiner* — Michael L Sehn
(74) *Attorney, Agent, or Firm* — Birch, Stewart, Kolasch & Birch, LLP

(57) ABSTRACT

A rotational body 1 includes a rotational shaft 2, an impeller 3, and a nut 6. The impeller includes a hub portion 4 having a peripheral surface 4*s* inclined to the axial direction of the rotational shaft and having an insert hole 4*h* in which the rotational shaft is inserted, and a blade portion 5. At least one of the rotational shaft or the insert hole of the hub portion has an interference fit portion 10 for fit between the rotational shaft and the impeller, where the outside diameter of the rotational shaft is larger than the inside diameter of the insert hole of the hub portion. The interference fit portion is formed in a region which does not include the largest outside diameter portion 4B where the hub portion has a largest outside diameter, with the rotational shaft and the impeller mating with each other.

13 Claims, 8 Drawing Sheets

(51) Int. Cl.

| | |
|---|---|
| ***F04D 29/053*** | (2006.01) |
| ***F04D 29/28*** | (2006.01) |
| ***F04D 29/62*** | (2006.01) |
| ***F04D 29/66*** | (2006.01) |

(52) U.S. Cl.
CPC ..... *F04D 29/284* (2013.01); *F04D 29/624* (2013.01); *F04D 29/662* (2013.01); *F05D 2220/40* (2013.01); *F05D 2230/64* (2013.01); *F05D 2260/37* (2013.01)

(56) References Cited

U.S. PATENT DOCUMENTS

| | | | | |
|---|---|---|---|---|
| 6,449,950 | B1 | 9/2002 | Allen et al. | |
| 7,909,578 | B2 * | 3/2011 | Nishiyama | F01D 5/025 416/204 A |
| 2004/0131469 | A1 | 7/2004 | Billington | |
| 2005/0123417 | A1 | 6/2005 | Del Vecchio et al. | |
| 2006/0204386 | A1 | 9/2006 | Yoshida et al. | |
| 2007/0128044 | A1 | 6/2007 | Kawai et al. | |
| 2013/0115088 | A1 * | 5/2013 | Castan | F04D 29/054 416/204 A |
| 2013/0272895 | A1 | 10/2013 | Nakaniwa et al. | |

FOREIGN PATENT DOCUMENTS

| | | | |
|---|---|---|---|
| CN | 1815034 | A | 8/2006 |
| CN | 1975173 | A | 6/2007 |
| CN | 203081853 | U | 7/2013 |
| DE | 10 2007 047 668 | A1 | 4/2009 |
| JP | 58-176499 | A | 10/1983 |
| JP | 62-97297 | U | 6/1987 |
| JP | 63-183434 | U | 11/1988 |
| JP | 2-75725 | A | 3/1990 |
| JP | 2004-60460 | A | 2/2004 |
| JP | 2005-2849 | A | 1/2005 |
| JP | 4432638 | B2 | 3/2010 |
| JP | 2012-172645 | A | 9/2012 |
| JP | 2013-142359 | A | 7/2013 |

OTHER PUBLICATIONS

Extended European Search Report dated Nov. 18, 2016 issued in corresponding EP Application No. 13899261.5.

Chinese Office Action and Search Report for Chinese Application No. 201380080509.5, dated Apr. 2, 2018.

Chinese Office Action and Search Report for Chinese Application No. 201380080509.5, dated Oct. 8, 2016, with an English translation thereof.

International Preliminary Report on Patentability and Written Opinion of the International Searching Authority (Forms PCT/IB/338, PCT/IB/373, PCT/IB/326 and PCT/ISA/237), dated Jun. 23, 2016, for International Application No. PCT/JP2013/083206, with an English translation of the Written Opinion.

International Search Report (Forms PCT/ISA/220 and PCT/ISA/210), dated Jan. 21, 2014, for International Application No. PCT/JP2013/083206.

Chinese Office Action dated Aug. 2, 2017 issued to the corresponding CN Application No. 201380080509.5 wqith an English Translation.

* cited by examiner

ROTATIONAL BODY AND METHOD FOR MANUFACTURING THE SAME

TECHNICAL FIELD

The present disclosure relates to a rotational body including a rotational shaft and an impeller mating with the rotational shaft on an end side, and a method for manufacturing such a rotational body.

BACKGROUND

It is known that intake air is compressed by a supercharger such as a turbocharger or a mechanical supercharger and the compressed air is supplied to an engine (i.e. supercharging) as a technique for improving the output of the engine, and such method is widely used in the field of engines for vehicles, for example.

A supercharger includes a compressor rotational body including a rotational shaft and a compressor impeller mating with the rotational shaft on an end side of the rotational shaft. The compressor rotational body is configured so as to be rotated at high speed by e.g. a turbine impeller or an electric motor provided coaxially with the compressor rotational body.

Usually, a rotational shaft and a compressor impeller are separately manufactured and have their balance adjusted separately, and then they are assembled together into a compressor rotational body.

A compressor rotational body is assembled typically by means of a method called "clearance fit" (loose fit).

The clearance fit is a method where the outside diameter of the shaft is set to be smaller than the inside diameter of the hole which the shaft mates with. By this method, a small gap is formed between the rotational shaft and the compressor impeller, and thus, the compressor rotational body may be assembled with the center positions of the rotational shaft and the compressor impeller out of alignment to the extent of the size of the gap. If the compressor rotational body is assembled with the center positions of the two out of alignment, the center of gravity of the rotational body may not align with the center position, and accordingly, an eccentric load may applied to the compressor rotational body during rotation at high speed, which may cause breakage, abnormal noise, or the like. The misalignment between the center of gravity and the center position of the rotational body may be removed in the balance adjustment (processing) in a subsequent process. However, if the amount of misalignment is too large, the misalignment may not be removed by processing, and disassembling and reassembling may be necessary.

In order to solve the above problem, method called "interference fit" may be employed to assemble the rotational shaft and the compressor impeller. The interference fit is a method where the outside diameter of the shaft is set to be larger than the inside diameter of the hole which the shaft mates with. As the diameter of the shaft is larger than the diameter of the hole, press fitting, shrink fitting where the compressor impeller is heated, cooling fitting where the rotational shaft is cooled, or the like are employed for the assembly.

For example, Patent Document 1 discloses a technique where the outside diameter of a part of the rotational shaft is formed to have a slightly larger than the inside diameter of the insert hole of the compressor impeller, and the rotational shaft and the compressor impeller are assembled together through interference fit between the large-diameter part of the rotational shaft and the insert hole of the compressor impeller.

Patent Document 2 discloses a technique where the outside diameter of a part of a nut to be screwed on the rotational shaft on an end side of the rotational shaft is formed to have a slightly larger than the inside diameter of the insert hole of the impeller, and the rotational shaft and the compressor impeller are assembled together through interference fit between the large-diameter part of the nut and the insert hole of the impeller.

CITATION LIST

Patent Literature

Patent Document 1: JP 4432638 B
Patent Document 2: JP 2013-142359 A

SUMMARY

Technical Problem

In the technique disclosed in Patent Document 1, the large-diameter part of the rotational shaft is formed in a region which includes the largest outside diameter portion where the hub has the largest outside diameter in the axial direction of the rotational shaft (see FIG. 2 of Patent Document 1). As the largest centrifugal force acts on the portion where the hub has the largest outside diameter during rotation at high speed, a gap may be formed between the insert hole of the compressor impeller and the rotational shaft during rotation. Thus, with the above configuration of Patent Document 1, the center positions of the rotational shaft and the compressor impeller may be misaligned with each other.

In the technique disclosed in Patent Document 2, the impeller is allowed to mate not with the rotational shaft but with the nut screwed on the end portion of the rotational shaft. With such configuration of Patent Document 2, since the rotational shaft and the impeller do not directly mate with each other and a gap is formed between the rotational shaft and the impeller, the center positions of the rotational shaft and the impeller may be misaligned with each other during rotation at high speed.

At least an embodiment of the present invention has been made in view of the above problems and is to provide a rotational body with which a gap is not formed between the rotational shaft and the impeller even during rotation at high speed in the interference fit portion where the rotational shaft and the impeller mate with each other, and thus the center positions of the rotational shaft and the impeller is not misaligned with each other, and to provide a method for manufacturing such a rotational body.

Solution to Problem (1) At least an embodiment of a rotational body according to the present invention comprises: a rotational shaft; an impeller mating with the rotational shaft on an end side of the rotational shaft; and a nut screwed on the rotational shaft on an end side of the rotational shaft to fasten the rotational shaft and the impeller together. The impeller includes a hub portion having a peripheral surface inclined to an axial direction of the rotational shaft and having an insert hole in which the rotational shaft is inserted, and a blade portion provided so as to protrude from the circumferential surface of the hub portion toward a radial direction. At least one of the rotational shaft or the insert hole of the hub portion has formed an interference fit portion for fit between the impeller and the rotational shaft where an outside diameter of the rotational shaft is larger than an inside diameter of the insert hole of the hub portion. The interference fit portion is, in the axial direction of the rotational shaft, in a region which does not include a largest outside diameter portion where the hub portion has a largest outside diameter, with the rotational shaft and the impeller mating with each other.

In the rotational body according described in the above (1), the interference fit portion, which is a portion where the rotational shaft and the impeller mates with each other, is in a region which does not include the largest outside diameter portion where the hub portion has a largest outside diameter in the radial direction, with the rotational shaft and the impeller mating with each other. That is, the interference fit portion is not formed in a region where the largest centrifugal force acts during rotation at high speed. Accordingly, in the interference fit portion, a gap is less likely to be formed between the rotational shaft and the impeller by the action of the centrifugal force, whereby it is possible to suppress misalignment between the center position of the rotational shaft and the center position of the impeller.

(2) In some embodiments, the interference fit portion includes a smaller-diameter hole portion of the insert hole of the hub portion, the smaller-diameter hole portion having a smaller diameter than the rest of the insert hole.

In the rotational body described in the above (2), the interference fit portion includes a smaller-diameter hole portion of the insert hole of the hub portion. Thus, in assembling the rotational shaft and the impeller by employing a mechanical method such as press fitting, it is possible to make the travel distance (slide distance between the smaller-diameter hole portion of the impeller and the rotational shaft) where a press fitting load is required shorter than the case where the interference fit portion is formed on the rotational shaft. Accordingly, the assembling property of the rotational body becomes good, and it is possible to reduce a risk of damage on the rotational shaft and the impeller caused by sliding of the interference fit portion.

(3) In some embodiments, the interference fit portion includes a larger-diameter portion of the rotational shaft, the larger-diameter portion having a larger diameter than the rest of the rotational shaft.

The amount of interference of the interference fit portion is very small as having a size of e.g. the order of ten micrometers or smaller, and thus the processing or the test is easier when a larger-diameter portion is formed on the outer circumferential surface of the rotational shaft than when a smaller-diameter hole portion is formed on the inner circumferential surface of the insert hole. Accordingly, when the rotational body described in the above (3) is employed, the processing accuracy of the interference fit portion is more likely to be maintained than when interference fit portion is formed on the insert hole of the impeller.

(4) In some embodiments, the interference fit portion includes a smaller-diameter hole portion of the insert hole of the hub portion, the smaller-diameter hole portion having a smaller diameter than the rest of the insert hole, and a larger-diameter portion of the rotational shaft, the larger-diameter portion having a larger diameter than the rest of the rotational shaft.

According to the rotational body described in the above (4), it is possible to obtain the above-described effect by the configuration where the interference fit portion includes the smaller-diameter hole portion of the insert hole of the hub portion, and the above-described effect by the configuration where the interference fit portion includes the larger-diameter portion of the rotational shaft.

In this case, it is possible to avoid the problem related to the processing accuracy, which is a problem when the smaller-diameter hole portion is formed on the insert hole, by forming the smaller-diameter hole portion on the insert hole first, and then forming the larger-diameter portion on the rotational shaft while adjusting the amount of interference of the interference fit portion with the outside diameter of the larger-diameter portion.

(5) In some embodiments, in the rotational body described in the above (2), the smaller-diameter hole portion includes a burr of an impression formed on an inner circumferential surface of the insert hole of the hub portion.

(6) In some embodiments, in the rotational body described in the above (3), the larger-diameter portion includes a burr of an impression formed on an outer circumferential surface of the rotational shaft.

The amount of interference of the interference fit portion is about several micrometers at the smallest. When an impression is formed on a material surface by e.g. dimple processing, a burr having a size of the order of micrometers may be formed. According to the rotational body described in the above (5) or (6), by utilizing the small formation change associated with formation of the impression, it is possible to form an amount of interference of a small size in the interference fit portion.

(7) In some embodiments, in the rotational body described in the above (2), the smaller-diameter hole portion has a larger surface roughness than the rest of the insert hole.

(8) In some embodiments, in the rotational body described in the above (3), the larger-diameter portion has a larger surface roughness than the rest of the rotational shaft.

According to the rotational body described in the above (7) or (8), by permitting the interference fit portion to have a larger surface roughness to have a larger coefficient of friction, it is possible to suppress misalignment between the axial directions of the rotational shaft and the impeller during rotation at high speed, and also accompanying misalignment between the center positions of the rotational shaft and the impeller.

In this case, by forming the surface roughness (center line average roughness) to have the same length as the height of the step of the interference fit portion, it is possible to form the step of the interference fit portion with the surface roughness, whereby the processing property is good.

(9) In some embodiments, the interference fit portion is apart from the nut in the axial direction of the rotational shaft, with the rotational shaft and the impeller mating with each other.

In the interference fit portion, a frictional force preventing misalignment in the axial direction is generated between the rotational shaft and the impeller. On the other hand, an axial force corresponding to the fastening force of the nut acts between the nut and the interference fit portion. If the distance between the nut and the interference fit portion is too short, the length of the portion under the head of the nut is likely to be short and deformation amount by the axial force is likely to be small, whereby the nut may be more likely to be loose. According to the rotational body described in the above (9), by forming the interference fit portion apart from the nut, it is possible to ensure the length of the portion under the head of the nut, thereby to prevent the nut from becoming loose.

(10) In some embodiments, in the rotational body described in the above (9), the interference fit portion is, in the axial direction of the rotational shaft, in a region which includes an axial middle position of the hub portion, with the rotational shaft and the impeller mating with each other.

According to the rotational body described in the above (10), it is possible to moderately secure the length of the portion under the head of the nut, and to form the interference fit portion in a region other than where the largest centrifugal force acts during rotation at high speed.

In some embodiments, the insert hole of the hub portion is press-fitted on the rotational shaft so that the impeller mates with the rotational shaft in the interference fit portion.

The rotational body described in the above (1) to (10) may be assembled through a method such as press fitting, shrink fitting where the impeller is heated, or cooling fitting where the rotational shaft is cooled. Particularly, as the rotational body described in the above (11), by employing press-fitting between the rotational shaft and the impeller, it is possible to allow the rotational shaft and the impeller to mate with each other without thermal deformation. Thus, a problem of loose nut due to thermal deformation, which may be concerned about when shrink fitting or cooling fitting is employed, does not arise.

Among the rotational body described in the above (1) to (10), particularly in the rotational body described in the above (2), as the travel distance (slide distance between the rotational shaft and the smaller-diameter hole portion of the impeller) required for press fitting is short, as described above, the configuration of the rotational body is suitable for press fitting.

Further, in the rotational body described in the above (11), by reducing the length of the interference fit portion, it is possible to reduce the sliding resistance during press fitting to obtain a configuration suitable for press fitting. When L2/L11 is within a range of from 1/2 to 1/6, preferably from 1/3 to 1/5, where L1 is the length of the hub portion in the axial direction and L2 is the length of the interference fit portion in the axial direction, it is possible to ensure the fit between the rotational shaft and the impeller and to reduce the sliding resistance during press fitting.

(12) At least an embodiment of a manufacturing method is a method for manufacturing a rotational body including: a rotational shaft; an impeller mating with the rotational shaft on an end side of the rotational shaft; and a nut screwed on the rotational shaft on an end side of the rotational shaft to fasten the rotational shaft and the impeller together. The impeller includes a hub portion having a peripheral surface inclined to an axial direction of the rotational shaft and having an insert hole into which the rotational shaft is inserted, and a blade portion provided so as to protrude from the circumferential surface of the hub portion toward a radial direction. At least one of the rotational shaft or the insert hole of the hub portion has formed an interference fit portion for fit between the impeller and the rotational shaft where an outside diameter of the rotational shaft is larger than an inside diameter of the insert hole of the hub portion. The manufacturing method comprises a fitting step of inserting the rotational shaft into the insert hole of the hub portion and mating the rotational shaft and the impeller with each other in the interference fit portion so that the interference fit portion is formed in a region which does not include a largest outside diameter portion where the hub portion has a largest outside diameter.

The method for manufacturing a rotational body described in the above (12) comprises a fitting step of mating the rotational shaft and the impeller in the interference fit portion so that the interference fit portion is formed in a region which does not include a largest outside diameter portion where the hub portion has a largest outside diameter, with the rotational shaft and the impeller mating with each other. In the rotational body manufactured through the method including the above fitting step, the interference fit portion is formed in a region other than a portion where the largest centrifugal force acts during rotation at high speed, and thus, a gap is not formed between the rotational shaft and the impeller in the interference fit portion even during rotation at high speed. Thus, misalignment between the center position of the rotational shaft and the center position of the impeller is less likely to arise.

(13) In some embodiments, the manufacturing method further comprises a fastening step of screwing the nut on the rotational shaft from an end side of the rotational shaft to fasten the rotational shaft and the impeller together.

(14) In some embodiments, in the above manufacturing method described in the above (13), the fitting step includes a press-fitting step of press-fitting the insert hole of the hub portion onto the rotational shaft so that the rotational shaft and the impeller mate with each other in the interference fit portion.

Advantageous Effects

According to at least an embodiment of the present invention, it is possible to provide a rotational body and a manufacturing method thereof whereby in the interference fit portion where the rotational shaft and the impeller mates with each other, a gap is not formed between the rotational shaft and the impeller even during rotation at high speed, and accordingly misalignment between the center position of the rotor shaft and the center position of the impeller does not arise.

Figure 4A:
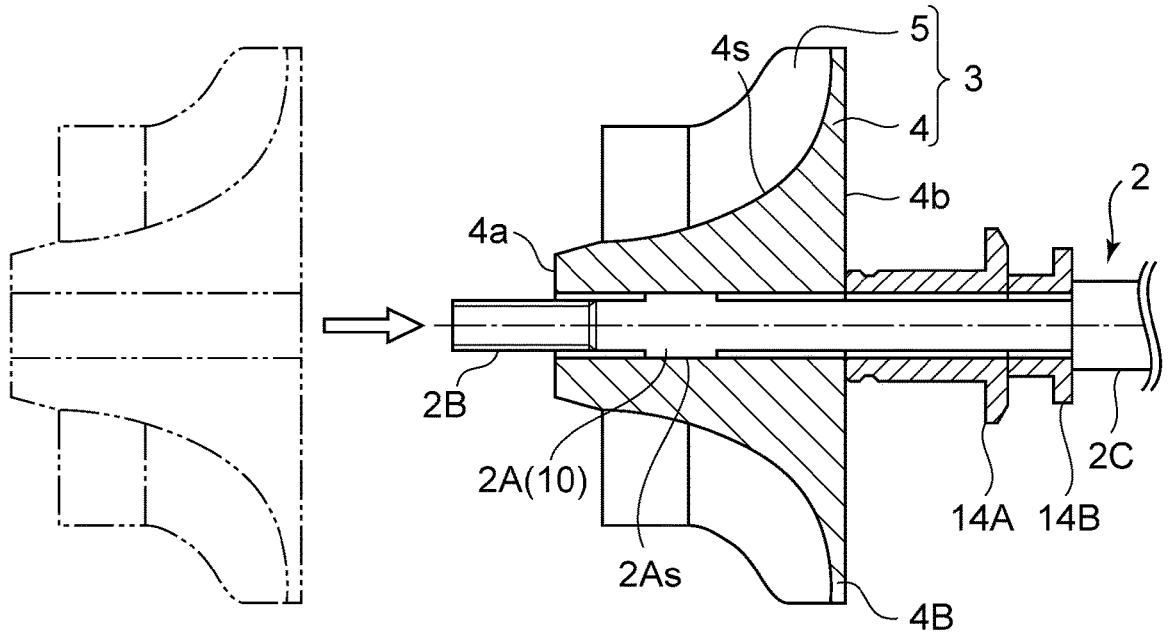
Figure 4B:
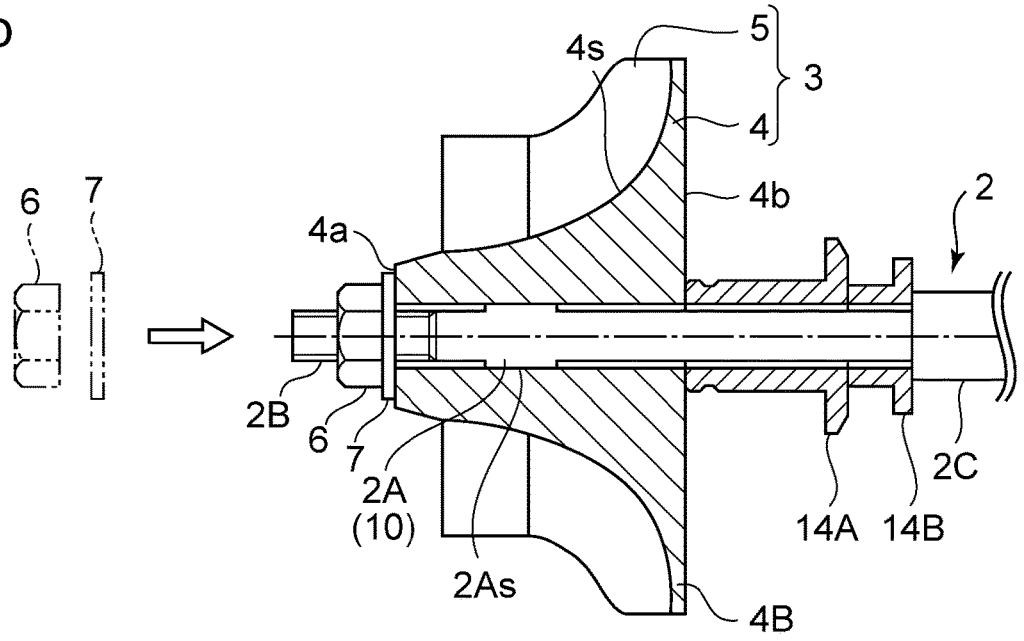

Each of FIG. 4*a* and FIG. 4*b* is a diagram illustrating assembling steps of a rotational body according to an embodiment of the present invention.

Figure 5:
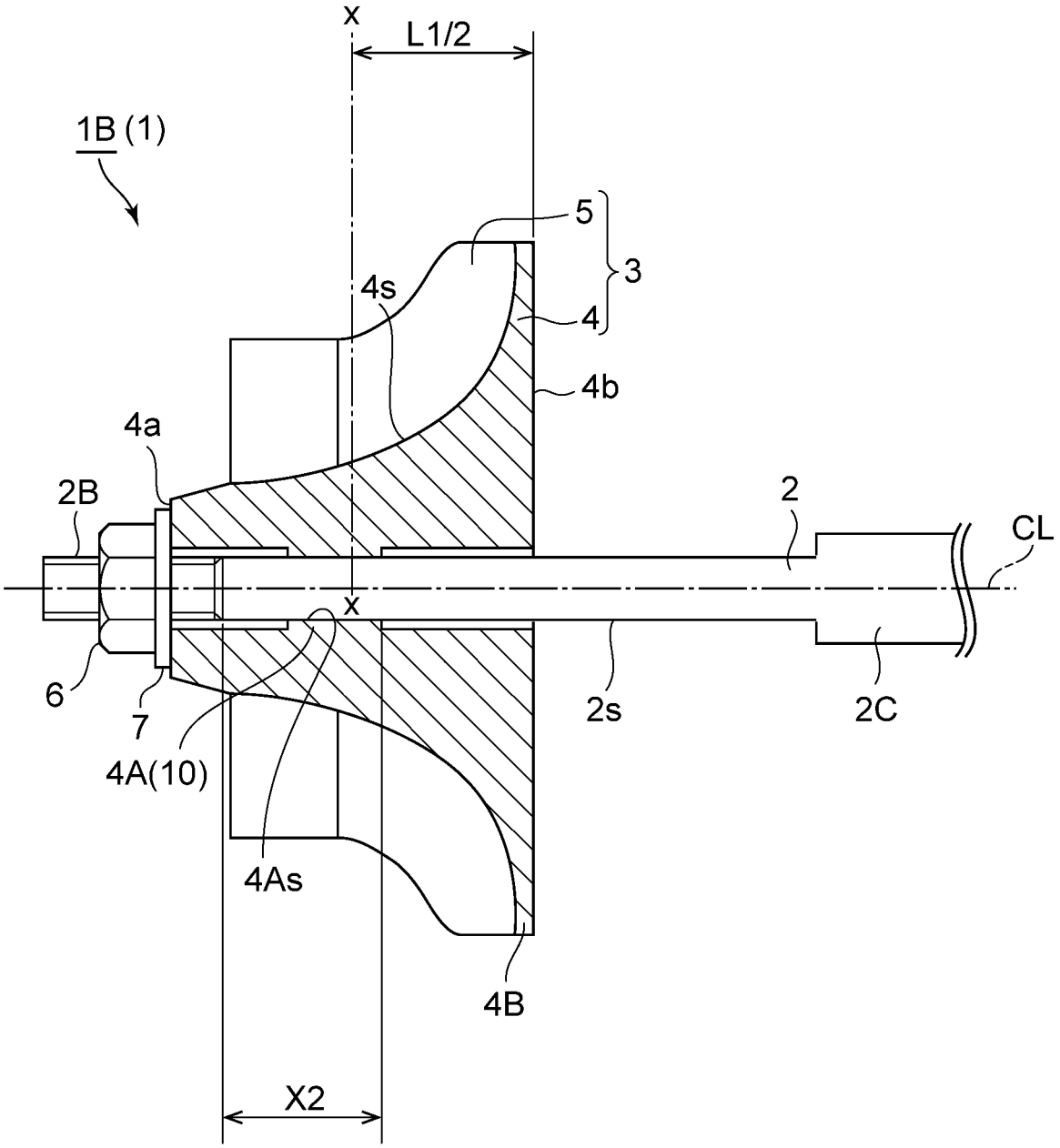

FIG. 5 is a cross-sectional view of a rotational body according to an embodiment of the present invention.

Figure 6:
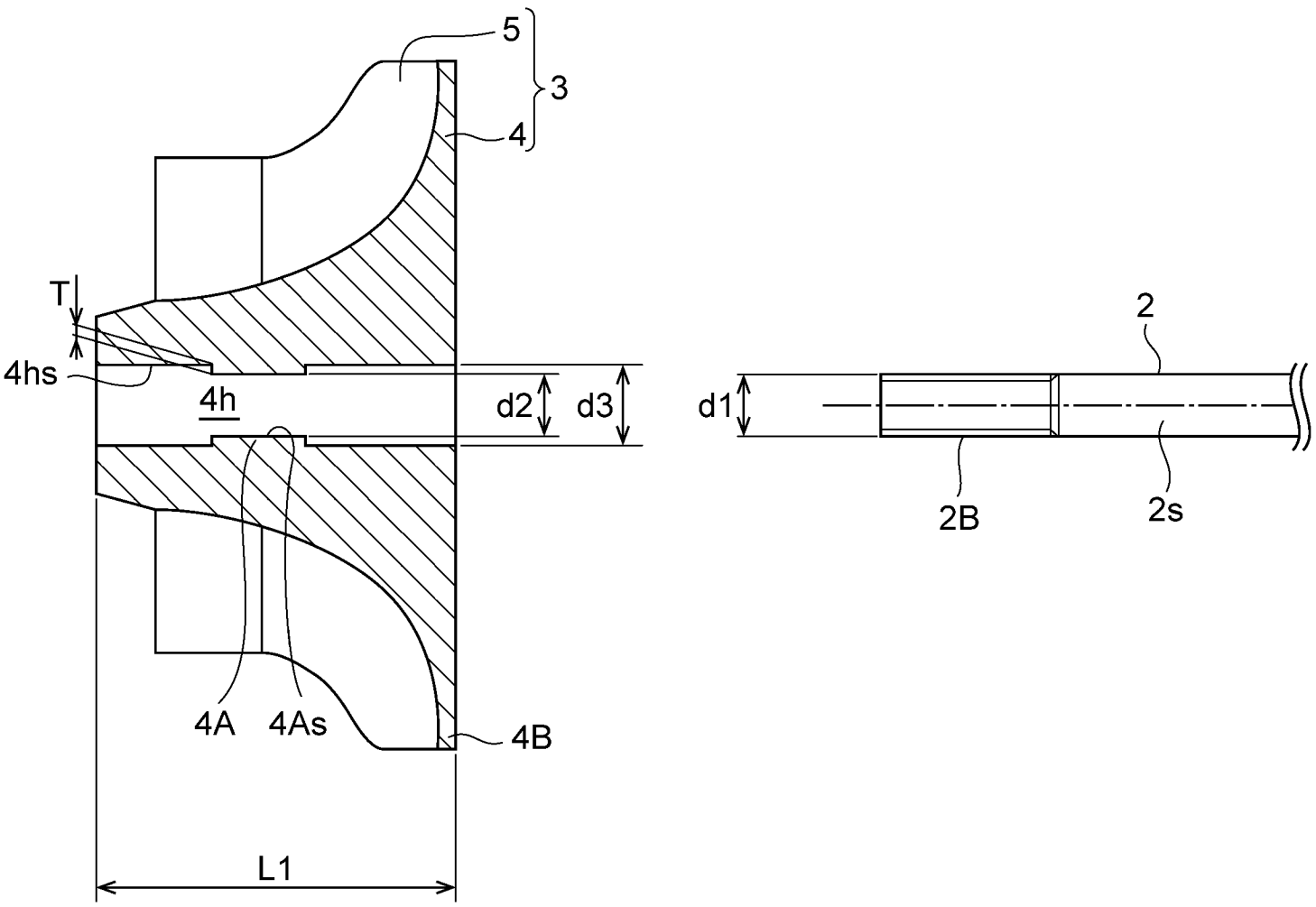

FIG. 6 is a cross-sectional view illustrating dimensional relation in a smaller-diameter hole portion (interference fit portion) of an insert hole.

Figure 7:
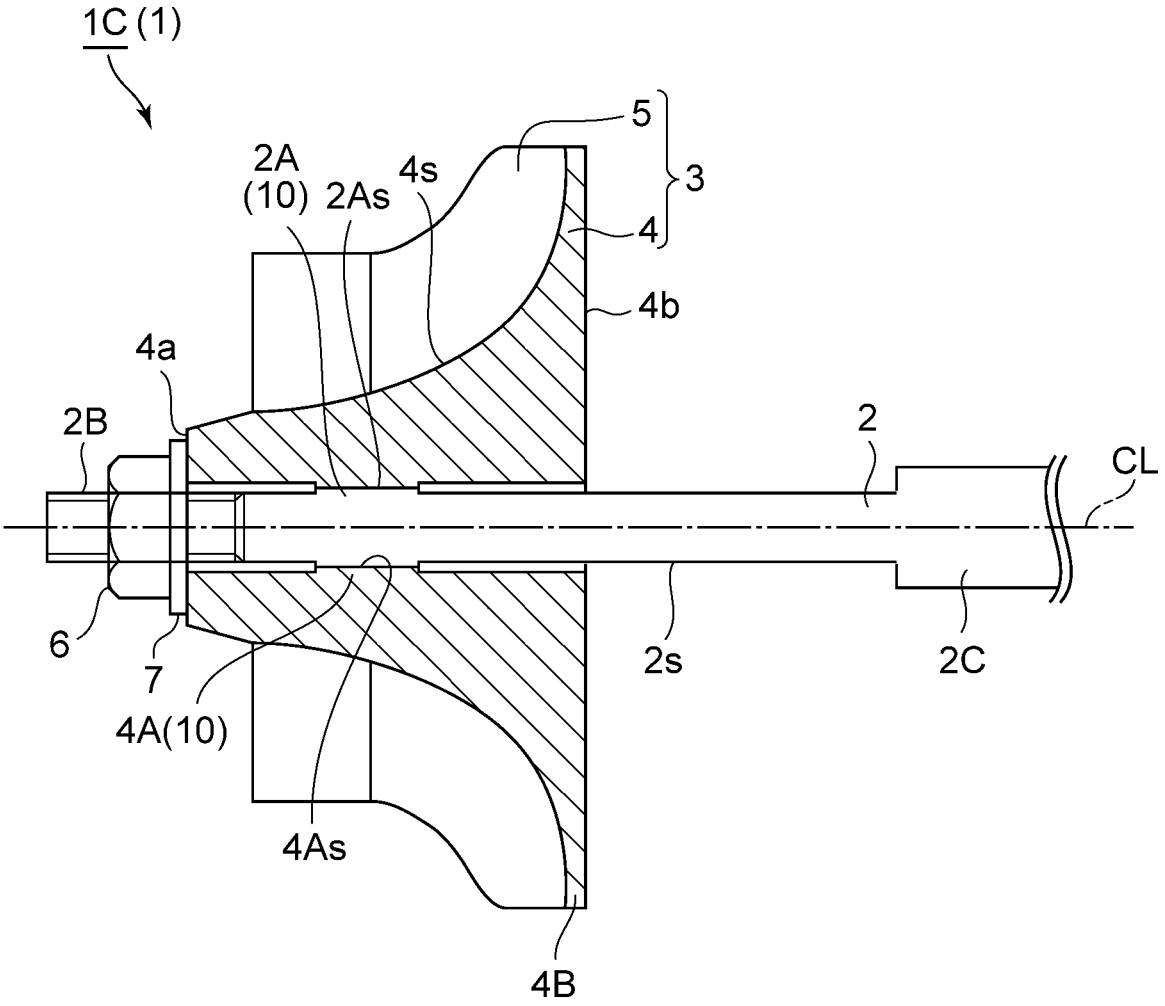

FIG. 7 is a cross-sectional view of a rotational body according to an embodiment of the present invention.

Figure 8A:
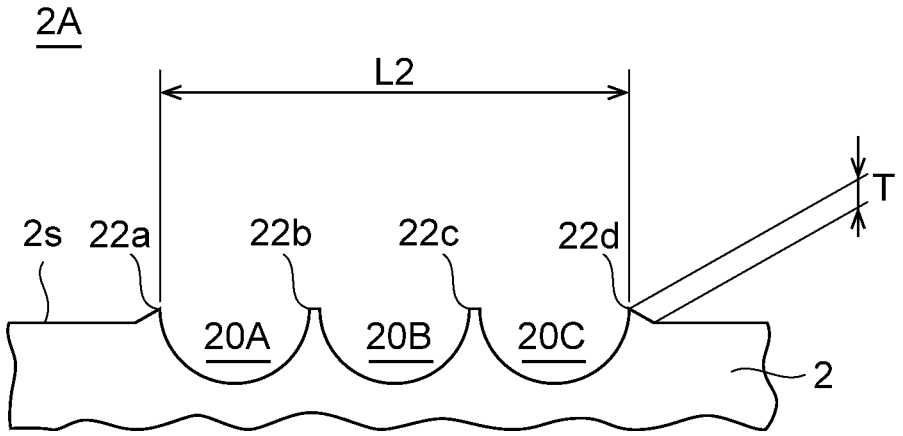
Figure 8B:
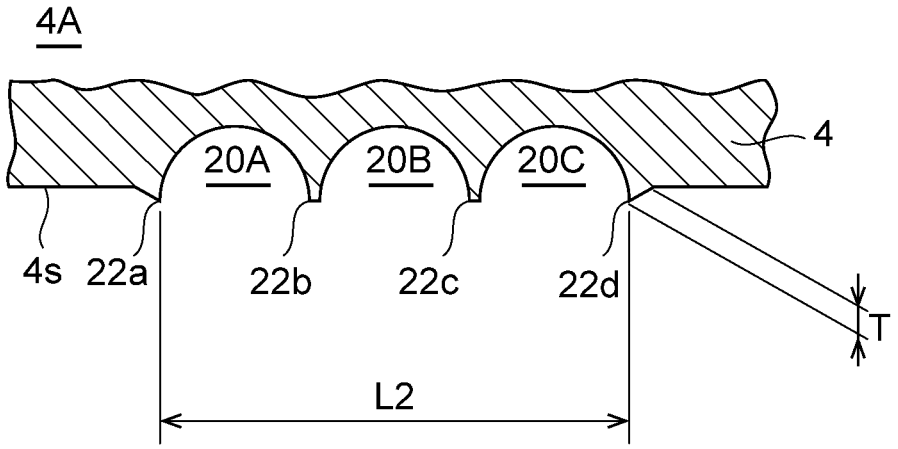

Each of FIG. 8*a* and FIG. 8*b* is an enlarged cross-sectional view of an interference fit portion. FIG. 8*a* is an enlarged cross-sectional view of a larger-diameter portion constituting an interference fit portion, and FIG. 8*b* is an enlarged cross-sectional view of a smaller-diameter hole portion constituting an interference fit portion.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Figure 1:
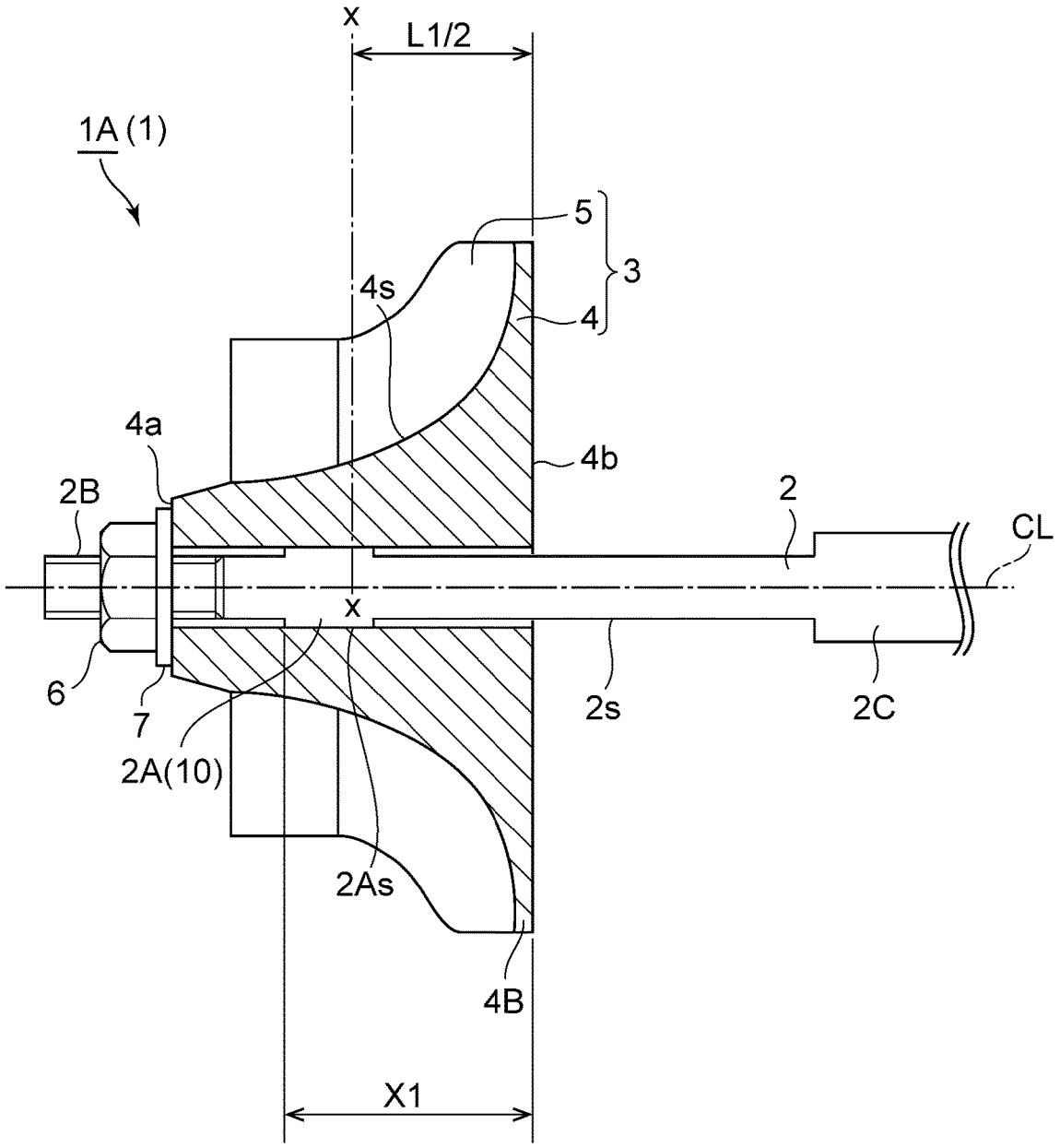
FIG. 1 is a cross-sectional view of a rotational body according to an embodiment of the present invention.

FIG. 1 is a cross-sectional view of a rotational body according to an embodiment of the present invention.

A rotational body 1 according to an embodiment of the present invention is, for example, a compressor rotational body 1A configured to rotate at high speed to compress intake air. The compressor rotational body 1A include, as shown in FIG. 1, a rotational shaft 2, a compressor impeller 3 mating with the rotational shaft 2 on an end side of the rotational shaft 2, a nut 6 fastening the rotational shaft 2 and the compressor impeller 3 together. The compressor rotational body 1A is configured to be rotated at high speed by a turbine impeller (not shown) or a electric motor (not shown) which is coaxially provided to compress intake air.

The compressor impeller 3 includes a hub portion 4 and a blade portion 5. The hub portion 4 is formed to have a shape of a circular truncated cone obtained by cutting off a top portion of a circular cone to have a top surface parallel to the bottom surface. An insert hole 4*h* is formed through the central part of the hub portion 4 along the axial direction (see FIG. 3). The hub portion 4 has a peripheral surface 4*s* inclined to the axial direction of the rotational shaft 2 (the central axis denoted with CL), and the peripheral surface 4*s* is formed so as to have gradually larger diameter as the position becomes closer from the top surface (tip surface 4*a*) to the bottom surface (back surface 4*b*). The symbol 4B in the drawing represents a largest outside diameter portion where the hub portion 4 has its largest outside diameter. The blade portion 5 is provided so as to protrude in the radial direction from the peripheral surface 4*s* of the hub portion 4. A plurality of the blade portions 5 are provided at prescribed intervals in the circumferential direction of the hub portion 4.

On an end side of the rotational shaft 2, a male thread portion 2B having a spiral-like thread is formed on the outer circumferential surface 2*s*, and the nut 6 is screwed on the male thread portion 2B. The rotational shaft 2 has a step portion 2C having a larger diameter than the end side of the rotational shaft 2, and the step portion 2C is formed in the vicinity of the middle portion of the rotational shaft 2.

In the illustrated embodiment, the rotational shaft 2 has, on the end side of the rotational shaft 2, a larger-diameter portion 2A having a larger diameter than the rest of the rotational shaft 2 at a position a little apart from the male thread portion 2B. In the illustrated embodiment, the larger-diameter portion 2A constitutes an interference fit portion 10 for the fit between the rotational shaft 2 and the compressor impeller 3.

Figure 2:
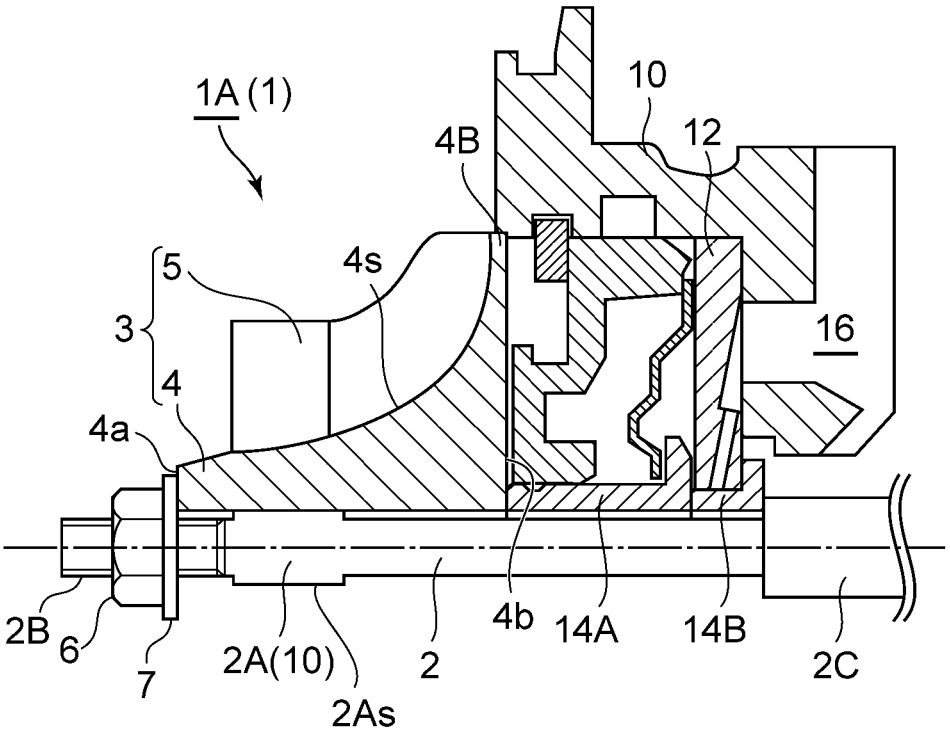
FIG. 2 is a partial cross-sectional view of a supercharger including a rotational body according to an embodiment of the present invention.

FIG. 2 is a partial cross-sectional view of a supercharger including a rotational body according to an embodiment of the present invention.

The compressor rotational body 1 has a rotational shaft 2 which is rotatably supported by a thrust bearing 12 accommodated in a bearing housing 10 and a journal bearing (not shown). Symbol 14A represents a thrust sleeve mounted on the outer circumferential surface of the rotational shaft 2, symbol 14B represents a thrust ring mounted on the outer circumferential surface of the rotational shaft 2, and symbol 16 represents a lubricating oil passage to supply lubricating oil to the respective bearings.

Figure 3:
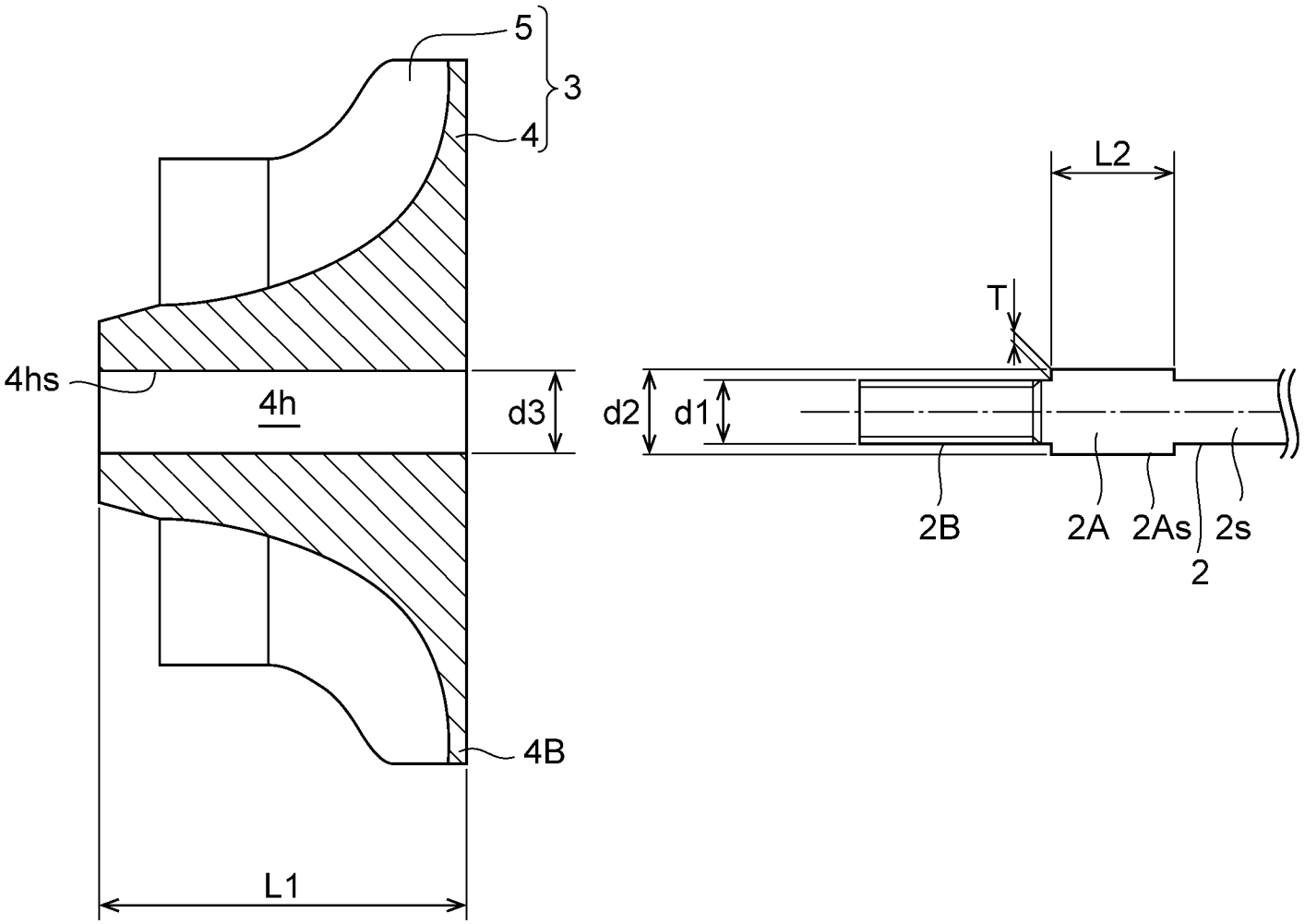
FIG. 3 is a cross-sectional view illustrating dimensional relation in a larger-diameter portion (interference fit portion) of a rotational shaft.

FIG. 3 is a diagram illustrating dimensional relation in a larger-diameter portion (interference fit portion) of a rotational shaft.

The above described larger-diameter portion 2A is formed so as to have an outside diameter d2 larger than the outside diameter d1 of the rest of the rotational shaft 2 by the height T of the step per the radius (d2=d1+2T). The insert hole 4*h* of the hub portion 4 is formed so as to have an inside diameter d3 larger than the outside diameter d1 of the rest of the rotational shaft 2 and smaller than the outside diameter d2 of the larger-diameter portion 2A (d2>d3>d1). The height T of the step may, for example, be about several micrometers to several tens of micrometers. Symbol L1 in FIG. 3 represents the length of the hub portion 4 in the axial direction, and symbol L2 represents the length of the larger-diameter portion 2A of the axial direction.

Each of FIG. 4*a* and FIG. 4*b* is a diagram illustrating assembling steps of a rotational body according to an embodiment of the present invention.

In the embodiment, as illustrated in FIG. 4(*a*), the insert hole 4*h* of the hub portion 4 is press-fitted from the end side of the rotational shaft 2, with the thrust sleeve 14A and the thrust ring 14B mounted on the rotational shaft 2. The thrust ring 14B is mounted on the rotational shaft 2 with its back surface being in contact with the step portion 2C. The thrust sleeve 14A is mounted on the rotational shaft with its back surface being in contact with a tip portion of the thrust ring 14B. The rotational shaft 2 is inserted into the compressor impeller 3 to the position such that the back surface 4*b* of the hub portion 4 becomes in contact with the tip portion of the thrust ring 14B. Then, the rotational shaft 2 and the compressor impeller 3 are allowed to mate with each other in the interference fit portion 10 (press fitting step).

Symbol X1 in FIG. 1 represents the travel distance when the rotational shaft 2 is inserted into the insert hole 4*h* by applying a press fitting load.

As the outside diameter d2 of the rotational shaft 2 is larger than the inside diameter d3 of the insert hole 4*h*, as a method for inserting the rotational shaft 2 into the insert hole 4*h* of the hub portion 4, in addition to the above-described press fitting, various known interference fitting methods such as shrink fitting where the compressor impeller 3 is heated, and cooling fitting where the rotational shaft 2 is cooled may be employed (fitting step).

Then, as illustrated in FIG. 4*b*, the nut 6 is screwed from the end side of the rotational shaft 2 to push the tip surface 4*a* of the hub portion 4, thereby to fasten the rotational shaft 2 and the compressor impeller 3 together (fastening step). In this case, by providing a washer 7 between the nut 6 and the tip surface of the hub portion 4, it is possible to stably fasten the rotational shaft 2 and the compressor impeller 3 and to provide an effect of preventing the nut 6 from becoming loose.

In a compressor rotational body 1 according to at least an embodiment of the present invention, as illustrated in FIG. 1, the above-described larger-diameter portion 2A (interference fit portion 10) is formed, in the axial direction of the rotational shaft 2, in a region which does not includes the largest outside diameter portion 4B where the hub portion 4 has the largest outside diameter, with the rotational shaft 2 and the compressor impeller 3 mating with each other. That is, the hub portion 4 has the largest outside diameter on its back surface 4*b* side, and the interference fit portion 10 is formed in a position apart in the axial direction from the back surface 4*b* toward the end side of the rotational shaft 2.

According to the above-described compressor rotational body 1, the interference fit portion 10 is not formed in a region (the largest outside diameter portion 4B having the largest outside diameter) where the largest centrifugal force acts during rotation at high speed. Accordingly, in the interference fit portion 10, a gap is less likely to be formed between the rotational shaft 2 and the compressor impeller 3 by the action of the centrifugal force, whereby it is possible to suppress misalignment between the center position of the rotational shaft 2 and the center position of the compressor impeller 3.

FIG. 5 is a cross-sectional view of a rotational body according to an embodiment of the present invention.

In some embodiments, as illustrated in FIG. 5, the above-described interference fit portion 10 includes a smaller-diameter hole portion 4A of the insert hole 4*h* of the hub portion 4. The smaller-diameter hole portion 4A has a smaller diameter than the rest of the insert hole 4*h*.

FIG. 6 is a cross-sectional view illustrating dimensional relation in a smaller-diameter hole portion (interference fit portion) of an insert hole.

The smaller-diameter hole portion 4A is formed so as to have the inside diameter d2 smaller than the inside diameter d3 of the rest of the insert hole 4*h* by the height T of the step per radius (d2=d3−2T). The rotational shaft is formed so as to have the outside diameter d1 smaller than the inside diameter d3 of the insert hole 4*h* and larger than the inside diameter d2 of the smaller-diameter hole portion 4A (d3>d2>d1). The height T of the step may, for example, be about several micrometers to several tens of micrometers.

Also with respect to the rotational body 1B according to the embodiment illustrated in FIG. 5, as with the case of the compressor rotational body 1A according to the above embodiment, in the interference fit portion 10, the insert hole 4*h* of the hub portion 4 is press-fitted to the rotational shaft 2, for example, to permit the rotational shaft 2 and the compressor impeller 3 to mate with each other.

Symbol X2 in FIG. 5 represents the travel distance when the rotational shaft 2 is inserted into the insert hole 4*h* by applying a press fitting load.

In the rotational body 1B according to the above embodiment, the interference fit portion 10 includes a smaller-diameter hole portion 4A of the insert hole 4*h* of the hub portion 4. Thus, in assembling the rotational shaft 2 and the compressor impeller 3 by employing a mechanical method such as press fitting, it is possible to make the travel distance (slide distance between the smaller-diameter hole portion 4A of the compressor impeller 3 and the rotational shaft 2) where the press fitting load is required shorter than the case where the interference fit portion 10 includes the larger-diameter portion 2A of the rotational shaft 2. Accordingly, the assembling property of the rotational body 1B becomes good, and it is possible to reduce a risk of damage on the rotational shaft 2 and the compressor impeller 3 caused by sliding of the interference fit portion 10.

In some embodiments, as illustrated in FIG. 1, the interference fit portion 10 includes a larger-diameter portion 2A of the rotational shaft 2. The larger-diameter portion 2A has a larger diameter than the rest of the rotational shaft 2.

The amount of interference of the interference fit portion 10 is very small as having a size of e.g. the order of ten micrometers or smaller, and thus the processing or the test is easier when a larger-diameter portion 2A is formed on the outer circumferential surface 2*s* of the rotational shaft 2 than when a smaller-diameter hole portion 4A is formed on the inner circumferential surface 4*hs* of the insert hole 4*h*. Accordingly, when the rotational body 1A illustrated in FIG. 1 is employed, the processing accuracy of the interference fit portion 10 is more likely to be maintained than when the rotational body 1B illustrated in FIG. 5 where the interference fit portion 10 is formed on the insert hole 4*h* of the compressor impeller 3, is employed.

FIG. 7 is a cross-sectional view of a rotational body according to an embodiment of the present invention.

In some embodiments, as illustrated in FIG. 7, the interference fit portion 10 includes a smaller-diameter hole portion 4A of the insert hole 4*h* of the hub portion 4, and a larger-diameter portion 2A of the rotational shaft 2. The smaller-diameter hole portion 4A has a smaller diameter than the rest of the insert hole 4*h*, and the larger-diameter portion 2A has a larger diameter than the rest of the rotational shaft 2.

According to the rotational body 1C of the above embodiment, it is possible to obtain the above-described effect by the configuration where the interference fit portion 10 includes the smaller-diameter hole portion 4A of the insert hole 4*h* of the hub portion 4, and the above-described effect by the configuration where the interference fit portion 10 includes the larger-diameter portion 2A of the rotational shaft 2.

In this case, it is possible to avoid the problem related to the processing accuracy, which is a problem when the smaller-diameter hole portion 4A is formed on the insert hole 4*h*, by forming the smaller-diameter hole portion 4A on the insert hole 2*h* first, and then forming the larger-diameter portion 2A on the rotational shaft 2 while adjusting the amount of interference of the interference fit portion 10 with the outside diameter of the larger-diameter portion 2A.

Each of FIG. 8*a* and FIG. 8*b* is an enlarged cross-sectional view of an interference fit portion. FIG. 8*a* is an enlarged cross-sectional view of a larger-diameter portion constituting an interference fit portion, and FIG. 8*b* is an enlarged cross-sectional view of a smaller-diameter hole portion constituting an interference fit portion.

In some embodiments, as illustrated in FIG. 8*a*, in the rotational body 1A illustrated in FIG. 1, the larger-diameter portion 2A includes burrs 22*a*, 22*b*, 22*c* and 22*d* of impressions 20A, 20B and 20C formed on the outer circumferential surface 2*s* of the rotational shaft 2.

In some embodiments, as illustrated in FIG. 8*b*, in the rotational body 1B illustrated in FIG. 5, the smaller-diameter hole portion 4A includes burrs 22*a*, 22*b*, 22*c* and 22*d* of impressions 20A, 20B and 20C formed on the inner circumferential surface 4*s* of the insert hole 4*h* of the hub portion 4.

The amount of interference of the interference fit portion 10 is about several micrometers at the smallest. When an impression 20 is formed on a material surface by e.g. dimple processing, a burr 22 having a size of the order of micrometers may be formed. According to the above embodiments, by utilizing the small formation change associated with formation of the impression, it is possible to form an amount of interference of a small size in the interference fit portion 10.

In some embodiments, in the rotational body 1A illustrated in FIG. 1, the above-described larger-diameter portion 2A has a larger surface roughness than the rest of the rotational shaft 2.

In some embodiments, in the rotational body 1B illustrated in FIG. 5, the smaller-diameter hole portion 4A has a larger surface roughness than the rest of the insert hole 4*h*.

According to such embodiments, by permitting the interference fit portion 10 to have a larger surface roughness to have a larger coefficient of friction, it is possible to suppress misalignment between the axial direction of the rotational shaft 2 and the axial direction of the compressor impeller 3 during rotation at high speed, and also accompanying misalignment between the center position of the rotational shaft 2 and the center position of the compressor impeller 3.

In this case, by forming the surface roughness (center line average roughness) to have the same length as the height T of the step of the interference fit portion 10, it is possible to form the step T of the interference fit portion 10 with the surface roughness, whereby the processing property is good.

In some embodiments, as illustrated in each of FIG. 1 and FIG. 5, the above-described interference fit portion 10 is formed so as to be apart from the nut 6 in the axial direction of the rotational shaft 2, with the rotational shaft 2 and the compressor impeller 3 mating with each other.

In the interference fit portion 10, a frictional force preventing misalignment in the axial direction is generated between the rotational shaft 2 and the compressor impeller 3. On the other hand, an axial force corresponding to the fastening force of the nut 6 acts between the nut 6 and the interference fit portion 10. If the distance between the nut 6 and the interference fit portion 10 is too short, the length of the portion under the head of the nut 6 is likely to be short and deformation amount by the axial force is likely to be small, whereby the nut 6 may be more likely to be loose. Accordingly, by forming the interference fit portion 10 apart from the nut as illustrated in each of FIG. 1 and FIG. 5, it is possible to ensure the length of the portion under the head of the nut 6, thereby to prevent the nut 6 from becoming loose.

In some embodiments, as illustrated in each of FIG. 1 and FIG. 5, the interference fit portion 10 of the above-described rotational bodies 1A and 1B is, in the axial direction of the rotational shaft 2, formed in a region which includes an axial middle position of the hub portion 4, with the rotational shaft 2 and the compressor impeller 3 mating with each other.

That is, as illustrated FIG. 1 and FIG. 5, in the above-described rotational bodies 1A and 1B, the interference fit portion 10 is formed so as to be at a position of 1/2L (position X-X in the drawings) where L is the length of the hub portion 4 in the axial direction, with the rotational shaft 2 and the compressor impeller 3 mating with each other.

According to the above embodiment, it is possible to moderately secure the length of the portion under the head of the nut 6, and to form the interference fit portion 10 in a region other than where the largest centrifugal force acts during rotation at high speed. Thus, it is possible to suppress misalignment between the center position of the rotational shaft 2 and the center position of the compressor impeller 3 in the interference fit portion 10, and it is possible to ensure the length of the portion under the head of the nut 6, thereby to prevent the nut 6 from becoming loose.

In some embodiments, as described above, the insert hole 4*h* of the hub portion 4 is press-fitted on the rotational shaft 2 so that the compressor impeller 3 mates with the rotational shaft 2 in the interference fit portion 10.

The rotational body 1 according to the present invention may be assembled through a method such as press fitting, shrink fitting where the compressor impeller 3 is heated, or cooling fitting where the rotational shaft 2 is cooled. Particularly, as in the above-described embodiment, by employing press-fitting between the rotational shaft 2 and the compressor impeller 3, it is possible to allow the rotational shaft 2 and the compressor impeller 3 to mate with each other without thermal deformation. Thus, a problem of loose of the nut 6 due to thermal deformation, which may be concerned about when shrink fitting or cooling fitting is employed, does not arise.

Embodiments of the present invention are described in detail above, but the present invention is not limited thereto, and various amendments and modifications may be implemented within a scope that does not depart from the present invention.

For example, in the above-described embodiments, the rotational body 1 is a compressor rotational body 1 comprising the rotational shaft 2, the compressor impeller 3 mating with the rotational shaft 2 on the end side, and the nut 6 fastening the rotational shaft 2 and the compressor impeller 3 together, and the compressor rotational body 1 is configured to rotate at high speed to compress intake air. The rotational body 1 according to the present invention is not limited thereto, however, and it may, for example, be a turbine rotational body comprising a rotational shaft, a turbine impeller mating with another end side of the rotational shaft, and a nut fastening the rotational shaft and the turbine impeller together, and the turbine rotational body may be configured to be rotated at high speed by energy of exhaust gas.

INDUSTRIAL APPLICABILITY

The rotational body according to at least an embodiment of the present invention may be used preferably as a compressor rotational body or a turbine rotational body for a turbocharger.

REFERENCE SIGNS LIST

1, 1A-1C Rotational body (Compressor rotational body)
2 Rotational shaft
2A Larger-diameter portion (Interference fit portion 10)
2B Male thread portion
2C Step portion
2*s* Outer circumferential surface
3 Compressor impeller
4 Hub portion
4A Smaller-diameter hole portion (Interference fit portion 10)
4B Largest outside diameter portion
4*h* Insert hole
4*hs* Inner circumferential surface
4*s* Peripheral surface
5 Blade portion
6 Nut
7 Washer
10 Bearing housing
12 Thrust bearing
14A Thrust sleeve
14B Thrust ring
20, 20A-20C Impression
22, 22*a*-22*c* Burr

The invention claimed is:

1. A rotational body comprising:

a rotational shaft;

an impeller mating with the rotational shaft on an end side of the rotational shaft; and a nut screwed on the rotational shaft on an end side of the rotational shaft to fasten the rotational shaft and the impeller together, wherein the impeller includes a hub portion having a peripheral surface inclined to an axial direction of the rotational shaft and having an insert hole in which the rotational shaft is inserted, and a blade portion provided so as to protrude from the peripheral surface of the hub portion toward a radial direction, wherein at least one of the rotational shaft and the insert hole of the hub portion has formed a single interference fit portion for fit between the impeller and the rotational shaft where an outside diameter of the rotational shaft is larger than an inside diameter of the insert hole of the hub portion, wherein the single interference fit portion is, in the axial direction of the rotational shaft, in a region which does not include a largest outside diameter portion where the hub portion has a largest outside diameter, with the rotational shaft and the impeller mating with each other, wherein a length of the single interference fit portion, in the axial direction of the rotational shaft, is shorter than a length of the insert hole in the axial direction, wherein a diameter of the rotational shaft extending from one end of the fit portion is the same as a diameter of the rotational shaft extending from an opposite end of the fit portion, wherein the at least one of the rotational shaft and the insert hole of the hub portion has only the single interference fit portion, and the impeller and the rotational shaft are fit only at the single interference fit portion, and wherein the single interference fit portion is disposed at a position overlapping an imaginary line extending in a direction orthogonal to the axial direction and crossing a point at a half of a length of the hub portion in the axial direction of the rotational shaft.

2. The rotational body according to claim 1, wherein the single interference fit portion includes a smaller-diameter hole portion of the insert hole of the hub portion, the smaller-diameter hole portion having a smaller diameter than the rest of the insert hole.

3. The rotational body according to claim 2, wherein the smaller-diameter hole portion includes a burr of an impression formed on an inner circumferential surface of the insert hole of the hub portion.

4. The rotational body according to claim 2, wherein the smaller-diameter hole portion has a larger surface roughness than the rest of the insert hole.

5. The rotational body according to claim 1, wherein the single interference fit portion includes a larger-diameter portion of the rotational shaft, the larger-diameter portion having a larger diameter than the rest of the rotational shaft.

6. The rotational body according to claim 5, wherein the larger-diameter portion includes a burr of an impression formed on an outer circumferential surface of the rotational shaft.

7. The rotational body according to claim 5, wherein the larger-diameter portion has a larger surface roughness than the rest of the rotational shaft.

8. The rotational body according to claim 1, wherein the single interference fit portion includes a smaller-diameter hole portion of the insert hole of the hub portion, the smaller-diameter hole portion having a smaller diameter than the rest of the insert hole, and a larger-diameter portion of the rotational shaft, the larger-diameter portion having a larger diameter than the rest of the rotational shaft.

9. The rotational body according to claim 1, wherein the single interference lit portion is apart from the nut in the axial direction of the rotational shaft, with the rotational shaft and the impeller mating with each other.

10. The rotational body according to claim 1, wherein the insert hole of the hub portion is press-fitted on the rotational shaft so that the impeller mates with the rotational shaft in the single interference fit portion.

11. A method for manufacturing a rotational body including:

a rotational shaft;

an impeller mating with the rotational shaft on an end side of the rotational shaft; and a nut screwed on the rotational shaft on an end side of the rotational shaft to fasten the rotational shaft and the impeller together, wherein the impeller includes a hub portion having a peripheral surface inclined to an axial direction of the rotational shaft and having an insert hole into which the rotational shaft is inserted, and a blade portion provided so as to protrude from the peripheral surface of the hub portion toward a radial direction, wherein at least one of the rotational shaft and the insert hole of the hub portion has formed a single interference fit portion for fit between the impeller and the rotational shaft where an outside diameter of the rotational shaft is larger than an inside diameter of the insert hole of the hub portion, wherein a length of the single interference fit portion, in the axial direction of the rotational shaft, is shorter than a length of the insert hole, and wherein a diameter of the rotational shaft extending from one end of the fit portion is the same as a diameter of the rotational shaft extending from an opposite end of the fit portion, the manufacturing method, comprising:

providing the at least one of the rotational shaft and the insert hole of the hub portion with only the single interference fit portion, the single interference fit portion overlapping an imaginary line extending in a direction orthogonal to the axial direction and crossing a point at a half of a length of the hub portion in the axial direction of the rotational shaft, and a fitting step of inserting the rotational shaft into the insert hole of the hub portion and mating the rotational shaft and the impeller with each other in the single interference fit portion so that the single interference fit portion is formed in a region which does not include a largest outside diameter portion where the hub portion has a largest outside diameter.

12. The method for manufacturing a rotational body according to claim 11, further comprising a fastening step of screwing the nut on the rotational shaft from an end side of the rotational shaft to fasten the rotational shaft and the impeller together.

13. The method for manufacturing a rotational body according to claim 12, wherein the fitting step includes a press-fitting step of press-fitting the insert hole of the hub portion onto the rotational shaft so that the rotational shaft and the impeller mate with each other in the single interference fit portion.

* * * * *